US006302825B1

(12) United States Patent
Stearns et al.

(10) Patent No.: US 6,302,825 B1
(45) Date of Patent: Oct. 16, 2001

(54) EXERCISE METHODS AND APPARATUS

(76) Inventors: Kenneth W. Stearns, 8009 Cedel, Houston, TX (US) 77055; Joseph D. Maresh, 19919 White Cloud Cir., West Linn, OR (US) 97068

( * ) Notice: Subject to any disclaimer, the term of this patent is extended or adjusted under 35 U.S.C. 154(b) by 0 days.

(21) Appl. No.: 09/567,654

(22) Filed: May 9, 2000

Related U.S. Application Data

(63) Continuation of application No. 09/207,057, filed on Dec. 7, 1998, now Pat. No. 6,063,009, which is a continuation of application No. 08/837,986, filed on Apr. 15, 1997, now Pat. No. 5,848,954.

(51) Int. Cl.[7] ..... A63B 69/16; A63B 22/04
(52) U.S. Cl. ..... 482/52; 482/51
(58) Field of Search ..... 482/51, 52, 53, 482/57, 70, 71, 79, 80

(56) References Cited

U.S. PATENT DOCUMENTS

| | | | | |
|---|---|---|---|---|
| 4,185,622 | | 1/1980 | Swenson | 128/25 B |
| 4,786,050 | | 11/1988 | Geschwender | 272/73 |
| 4,962,925 | | 10/1990 | Chang | 482/62 |
| 5,279,529 | | 1/1994 | Eschenbach | 48/57 |
| 5,295,928 | | 3/1994 | Rennex | 482/52 |
| 5,383,829 | | 1/1995 | Miller | 482/57 |
| 5,397,286 | | 3/1995 | Chang | 482/62 |
| 5,423,729 | | 6/1995 | Eschenbach | 482/70 |
| 5,453,066 | | 9/1995 | Richter, Jr. | 482/57 |
| 5,518,473 | | 5/1996 | Miller | 482/57 |
| 5,529,554 | | 6/1996 | Eschenbach | 482/57 |
| 5,529,555 | | 6/1996 | Rodgers, Jr. | 482/57 |
| 5,540,637 | | 7/1996 | Rodgers, Jr. | 482/52 |
| 5,542,893 | | 8/1996 | Peterson et al. | 482/62 |
| 5,549,526 | | 8/1996 | Rodgers, Jr. | 482/57 |
| 5,562,574 | | 10/1996 | Miller | 482/51 |
| 5,573,480 | | 11/1996 | Rodgers, Jr. | 482/57 |
| 5,573,481 | | 11/1996 | Piercy et al. | 482/57 |
| 5,577,985 | | 11/1996 | Miller | 482/52 |
| 5,593,371 | | 1/1997 | Rodgers, Jr. | 482/70 |
| 5,759,136 | * | 6/1998 | Chen | 482/57 |
| 5,848,954 | * | 12/1998 | Stearns et al. | 482/52 |
| 5,879,271 | * | 3/1999 | Stearns et al. | 482/51 |
| 6,063,009 | * | 5/2000 | Stearns et al. | 482/52 |

* cited by examiner

*Primary Examiner*—Stephen R. Crow

(57) ABSTRACT

An exercise apparatus includes a crank rotatably mounted on a frame, and an axially extending support connected to the crank at a radially displaced location. Both a force receiving member and a discrete support member are linked to the axially extending support in such a manner that rotation of the crank relative to the frame is linked to movement of the force receiving member in a generally elliptical path relative to the frame.

10 Claims, 17 Drawing Sheets

Fig. 27
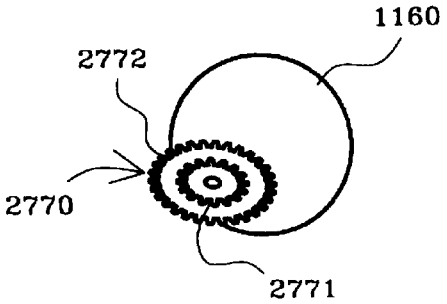
Fig. 28
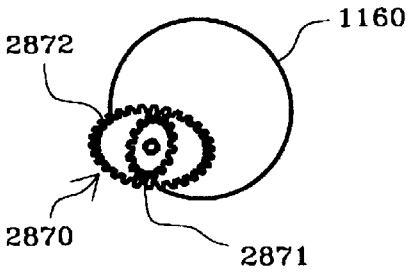
Fig. 29
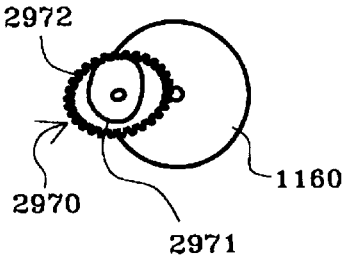
Fig. 30
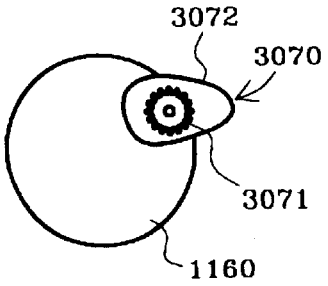
Fig. 31
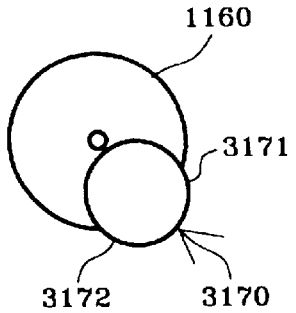
Fig. 32
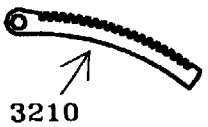
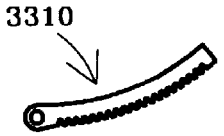
Fig. 33

EXERCISE METHODS AND APPARATUS

CROSS-REFERENCE TO RELATED APPLICATION

This application is a continuation of U.S. patent application Ser. No. 09/207,057, filed on Dec. 7, 1998, now U.S. Pat. No. 6,063,009, which is incorporated herein by reference, and which is a continuation of U.S. patent application Ser. No. 08/837,896, filed on Apr. 15, 1997, now U.S. Pat. No. 5,848,954.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Some examples of such equipment may be found in United States patents which are disclosed in an Information Disclosure Statement submitted herewith.

Exercise equipment has also been designed to facilitate full body exercise. For example, reciprocating cables or pivoting arm poles have been used on many of the equipment types discussed in the preceding paragraph to facilitate contemporaneous upper body and lower body exercise. Some examples of such equipment may be found in United States patents which are disclosed in an Information Disclosure Statement submitted herewith.

SUMMARY OF THE INVENTION

The present invention may be seen to provide a novel linkage assembly and corresponding exercise apparatus suitable for linking circular motion to relatively more complex, generally elliptical motion. In one embodiment, for example, a support member is pivotally mounted to a frame, and a force receiving member is movably mounted on the support member. A roller is rotatably mounted on a crank to support an opposite end of the support member and pivot the support member up and down in response to rotation of the crank. The force receiving member is linked to the crank in such a manner that movement of the force receiving member back and forth along the support member is linked to rotation of the crank. Thus, as the crank rotates, the linkage assembly constrains the force receiving member to travel through a generally elliptical path, having a relatively longer major axis and a relatively shorter minor axis. Moreover, the linkage is such that the major axis is longer than the effective diameter of the crank.

In another embodiment, for example, a roller is rotatably mounted on a crank and disposed between a force receiving member and a support member. Rotation of the crank causes the members to pivot up and down relative to the frame and the foot supporting member to move back and forth relative to the support member. The roller may be provided with a first diameter and/or gear set to engage the force receiving member and a second diameter and/or gear set to engage the support member. Such a linkage may be used to move the force receiving member through a range of motion having a dimension longer than the effective crank diameter.

In another respect, the present invention may be seen to provide a novel linkage assembly and corresponding exercise apparatus suitable for linking reciprocal motion to relatively more complex, generally elliptical motion. In either of the foregoing embodiments, for example, a handle member may be pivotally connected to the frame; and a link may be interconnected between the force receiving member and a discrete, relatively lower portion of the handle member. As the force receiving member moves through its generally elliptical path, the handle member pivots back and forth relative to the frame member.

In yet another respect, the present invention may be seen to provide a novel linkage assembly and corresponding exercise apparatus suitable for adjusting the angle of the generally elliptical path of motion relative to a horizontal surface on which the apparatus rests. In any of the foregoing embodiments, for example, the support member may be pivotally mounted to a first frame member, and/or the force receiving member may be pivotally mounted to a pivoting handle member, either of which may be locked in one of a plurality of positions along a post. An increase in the elevation of the pivot axis, results in a relatively more strenuous, "uphill" exercise motion.

BRIEF DESCRIPTION OF THE DRAWING

With reference to the Figures of the Drawing, wherein like numerals represent like parts and assemblies throughout the several views.

FIG. 27 is a side view of an alternative roller arrangement suitable for use with the present invention;

FIG. 28 is a side view of another alternative roller arrangement suitable for use with the present invention;

FIG. 29 is a side view of yet another alternative roller arrangement suitable for use with the present invention;

FIG. 30 is a side view of still another alternative roller arrangement suitable for use with the present invention;

FIG. 31 is a side view of yet one more alternative roller arrangement suitable for use with the present invention;

FIG. 32 is a side view of an alternative rack arrangement suitable for use with the present invention; and FIG. 33 is a side view of another alternative rack arrangement suitable for use with the present invention.

DETAILED DESCRIPTION OF THE PREFERRED EMBODIMENT

Figure 1:
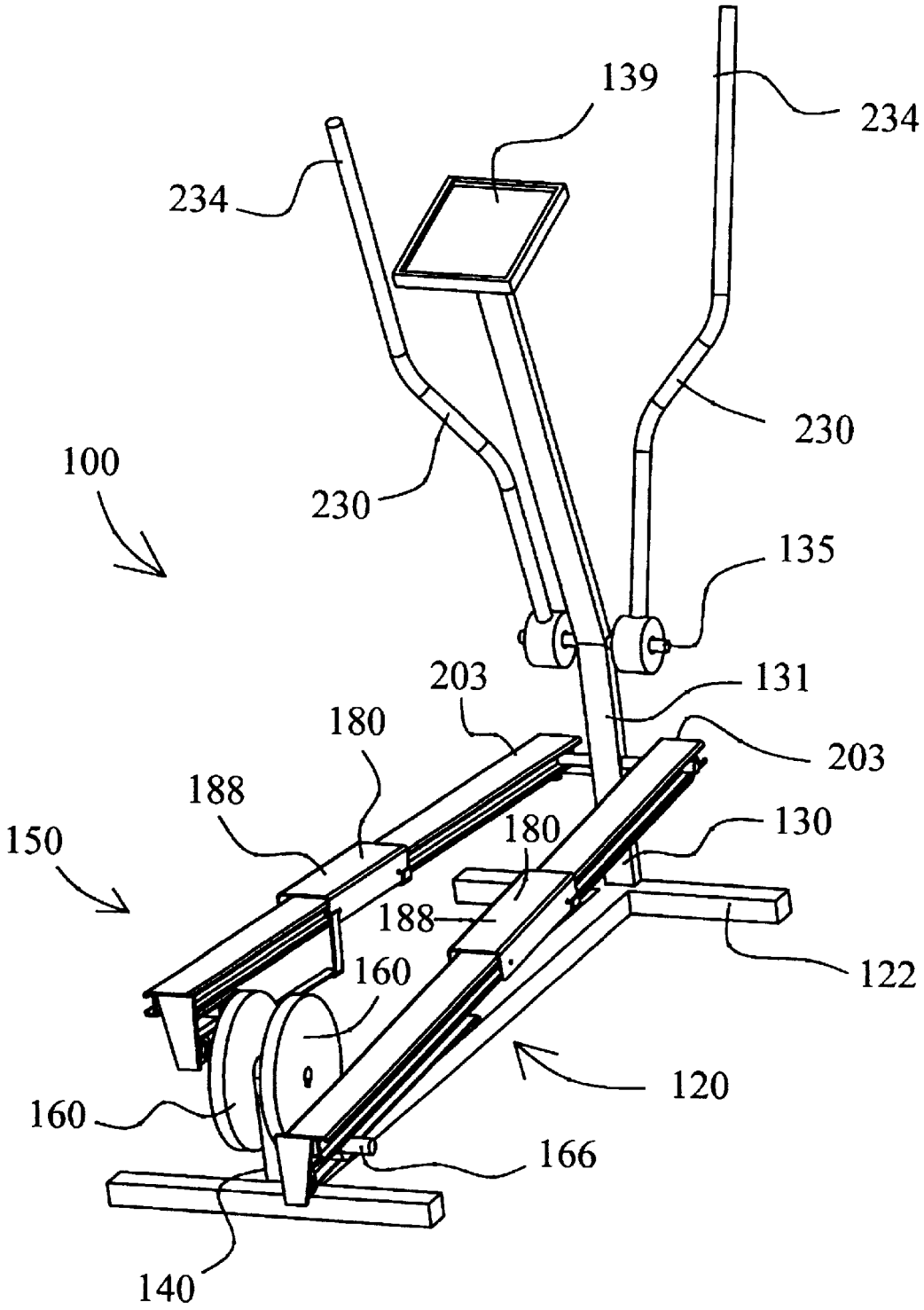
FIG. 1 is a perspective view of a first exercise apparatus constructed according to the principles of the present invention.
Figure 2:
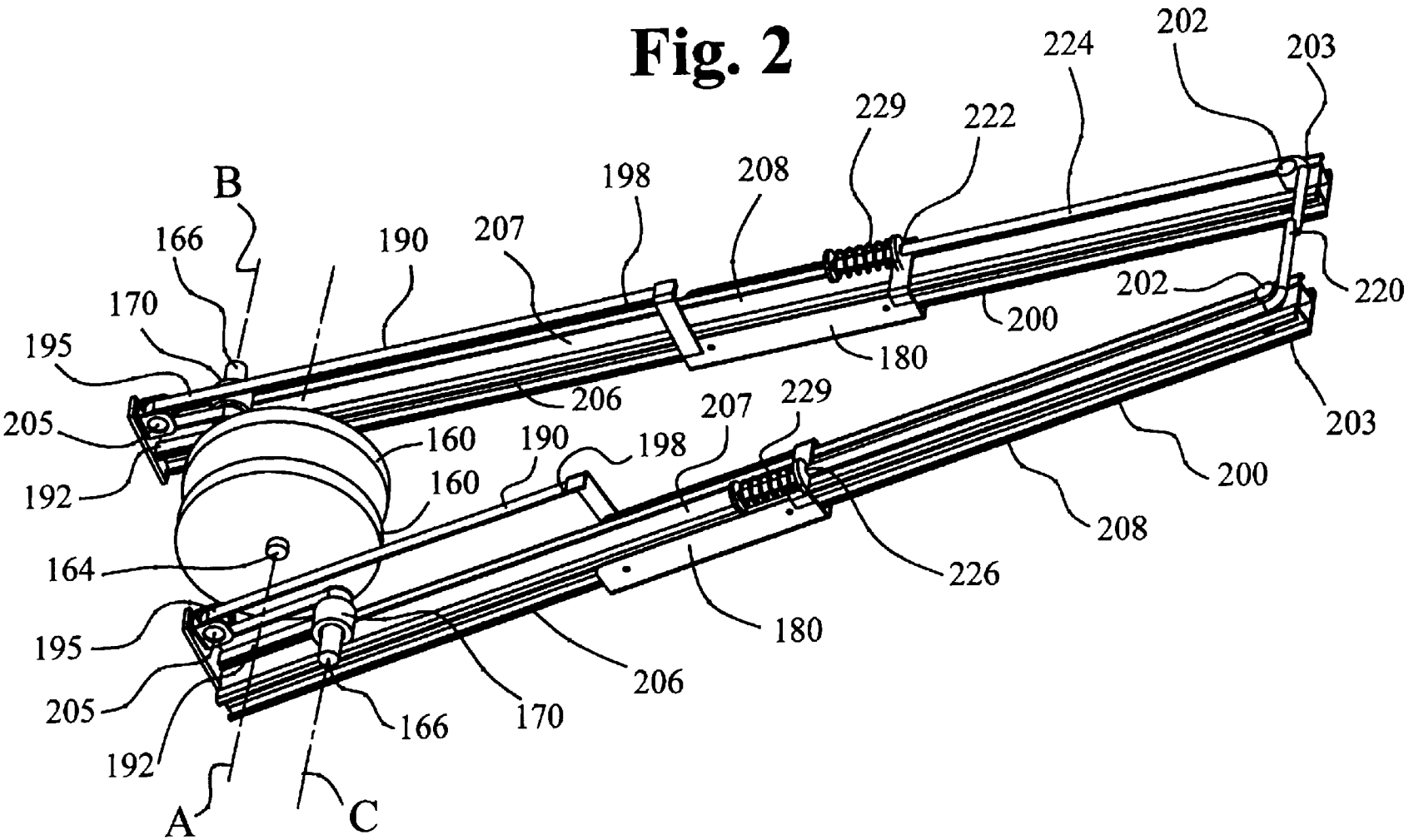
FIG. 2 is a perspective view of the underside of a linkage assembly on the exercise apparatus of FIG. 1.

A first exercise apparatus constructed according to the principles of the present invention is designated as 100 in FIGS. 1–4. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180. The term "elliptical motion" is intended in a broad sense to describe a closed path of motion having a relatively longer first axis and a relatively shorter second axis (which extends perpendicular to the first axis).

The frame 120 includes a base 122, a forward stanchion or upright 130, and a rearward stanchion or upright 140. The base 122 may be described as generally I-shaped and is designed to rest upon a generally horizontal floor surface 99 (see FIGS. 3 and 4). The apparatus 100 is generally symmetrical about a vertical plane extending lengthwise through the base 122 (perpendicular to the transverse members at each end thereof), the only exception being the relative orientation of certain parts of the linkage assembly 150 on opposite sides of the plane of symmetry. In the embodiment 100, the "right-hand" components are one hundred and eighty degrees out of phase relative to the "left-hand" components. However, like reference numerals are used to designate both the "right-hand" and "left-hand" parts on the apparatus 100, and when reference is made to one or more parts on only one side of the apparatus, it is to be understood that corresponding part(s) are disposed on the opposite side of the apparatus 100. Those skilled in the art will also recognize that the portions of the frame 120 which are intersected by the plane of symmetry exist individually and thus, do not have any "opposite side" counterparts. Moreover, to the extent that reference is made to forward or rearward portions of the apparatus 100, it is to be understood that a person could exercise while facing in either direction relative to the linkage assembly 150.

The forward stanchion 130 extends perpendicularly upward from the base 122 and supports a telescoping tube or post 131. A plurality of holes 138 are formed in the post 131, and at least one hole is formed in the upper end of the stanchion 130 to selectively align with any one of the holes 138. A pin 128, having a ball detent, may be inserted through an aligned pair of holes to secure the post 131 in any of several positions relative to the stanchion 130 (and relative to the floor surface 99). An upper, distal end of the post 131 supports a user accessible platform 139 which may, for example, provide information regarding and/or facilitate adjustment of exercise parameters.

A first hole extends laterally through the post 131 to receive a shaft 133 for reasons discussed below. A second hole extends laterally through the post 131 to receive a shaft 135 relative to which a pair of handle members 230 are rotatably secured. In particular, a lower end of each of the handle members 230 is rotatably mounted on an opposite end of the shaft 135 in such a manner that each handle member 230 is independently movable relative to one another and the post 131. Resistance to handle pivoting may be provided in the form of friction discs or by other means known in the art. Each handle member 230 also includes an upper, distal portion 234 which is sized and configured for grasping by a person standing on the force receiving member 180.

The rearward stanchion 140 extends perpendicularly upward from the base 122 and supports a bearing assembly. An axle 164 is inserted through a laterally extending hole in the bearing assembly to support a pair of flywheels 160 in a manner known in the art. For example, the axle 164 may be inserted through the hole, and then a flywheel 160 may be keyed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

A radially displaced shaft 166 is rigidly secured to each flywheel 160 by means known in the art. For example, the shaft 166 may be inserted into a hole in the flywheel 160 and welded in place. The shaft 166 extends axially away from the flywheel 160 at a point radially displaced from the axis A, and thus, the shaft 166 rotates at a fixed radius about the axis A. In other words, the shaft 166 and the flywheel 160 cooperate to define a crank having a crank radius.

A roller 170 is rotatably mounted on each shaft 166. The roller 170 on the right side of the apparatus 100 rotates about an axis B, and the roller 170 on the left side of the apparatus 100 rotates about an axis C. In the embodiment 100, each of the rollers 170 has a smooth cylindrical surface which bears against and supports a rearward portion or end 206 of a respective rail or support 200. In particular, the rearward end 206 may be generally described as having an inverted U-shaped profile into which an upper portion of the roller 170 protrudes. The "base" of the inverted U-shaped profile is defined by a flat bearing surface 207 which bears against or rides on the cylindrical surface of the roller 170. Those skilled in the art will recognize that other structures (e.g. the shaft 166 alone) could be used in place of the roller 170.

Each of the rails 200 extends from the rearward end 206 to a forward end 203, with an intermediate portion 208 disposed therebetween. The forward end 203 of each rail 200 is movably connected to the frame 120, forward of the flywheels 160. In particular, the shaft 133 may be inserted into a hole extending laterally through the tube 131 and into holes extending laterally through the forward ends 203 of the rails 200. The shaft 133 may be keyed in place relative to the stanchion 130, and the forward ends 203 on the shaft 133 may be secured in place by nuts.

A force receiving member 180 is rollably mounted on the intermediate portion 208 of each rail or track 200 in a manner known in the art. In the embodiment 100, the intermediate portions 208 may be generally described as having an I-shaped profile or as having a pair of C-shaped channels which open away from one another. Each channel 209 functions as a race or guide for one or more rollers rotatably mounted on each side of the foot skate 180. Each force receiving member or skate 180 provides an upwardly facing support surface 188 sized and configured to support a person's foot. Thus, the force receiving members 180 may be described as skates or foot skates, and the intermediate portions 208 of the rails 200 may be defined as the portions of the rails 200 along which the skates 180 may travel. Alternatively, the intermediate portions 208 may be defined as the portions of the rails 200 between the rearward ends 206 (which roll over the rollers 170) and the forward ends 203 (which are rotatably mounted to the frame 120).

In the embodiment 100, both the end portions 206 and the intermediate portions 208 of the support members 200 are linear. However, either or both may be configured as a curve without departing from the scope of the present invention. Recognizing that the rail 200 and the skate 180 cooperate to support a person's foot relative to the frame 120 and the crank 160, they may be described collectively as a foot support. Also, the rails 200 may be said to provide a means for movably interconnecting the flywheels 160 and the force receiving members 180; the rails 200 may also be said to provide a means for movably interconnecting the force receiving members 180 and the frame 120; and the rollers 170 may be said to provide a means for movably interconnecting the flywheels 160 and the rails 200.

The shafts 166 may be said to provide a means for interconnecting the flywheels 160 and the force receiving members 180. In particular, a separate flexible member or strap 190 is associated with the skate 180, rail 200, and flywheel 160 on each side of the apparatus 100. A first end 192 of each strap 190 is connected to a rail 200 proximate the rear end 206 thereof. An intermediate portion 195 of each strap 190 extends to and about the shaft 166, then to and about a pulley 205, which is rotatably mounted on the rail 200 proximate the rear end thereof. A second end 198 of each strap 190 is connected to the skate 180.

Figure 3:
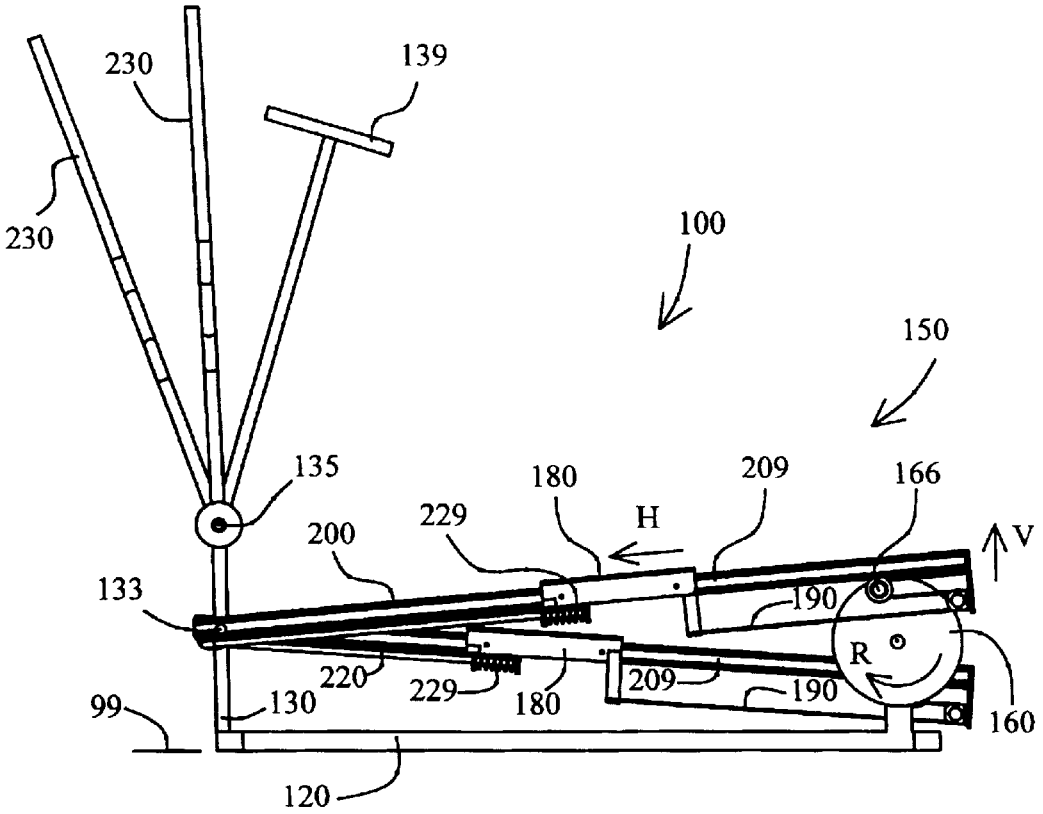
FIG. 3 is a side view of the exercise apparatus of FIG. 1, with portions broken away beneath the foot skates.
Figure 4:
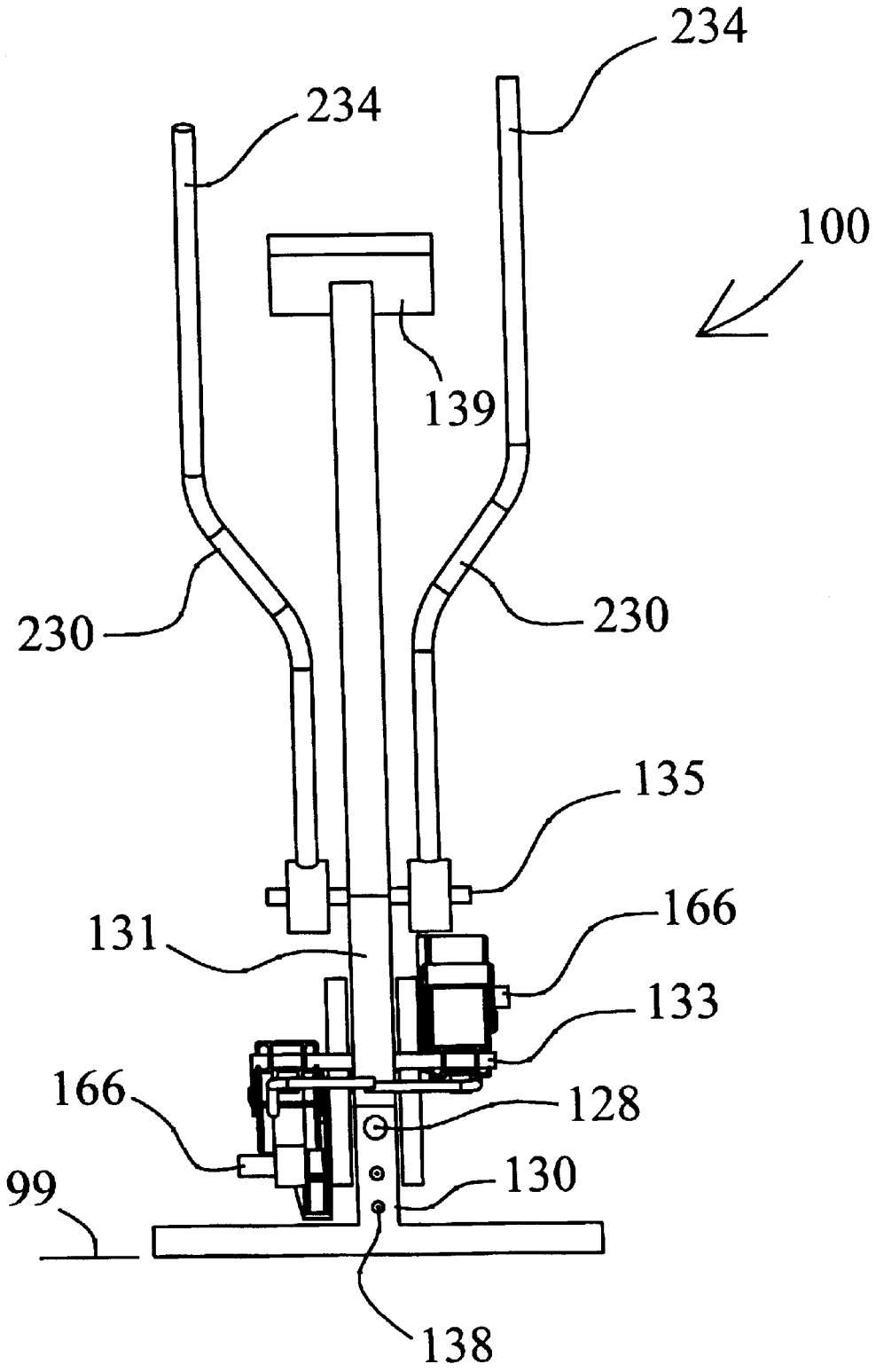
FIG. 4 is a front view of the exercise apparatus of FIG. 1.

An arrow R is shown on the left flywheel 160 in FIG. 3 to facilitate explanation of the relationship between rotation of the flywheel 160 and movement of the skate 180. As the flywheel 160 rotates in the direction R, the shaft 166 moves upward and rearward relative to the frame 120, the axis A, and the floor surface 99. Those skilled in the art will recognize that at this point in the cycle, the vertical component of the shaft's motion is significantly smaller than the horizontal component of the shaft's motion. Upward movement of the left shaft 166 causes the left rail 200 to move upward (as indicated by the arrow V), but the left rail 200 does not move rearward (or forward) because of its connection to the shaft 133 at the front stanchion 130. Recognizing that the left skate 180 is supported on the left rail 200, the left skate 180 moves upward (and downward) together with the left rail 200.

The left skate 180 also moves forward (as indicated by the arrow H) relative to the left rail 200, as the right skate 180 moves rearward relative to the right rail 200. In particular, on the right side of the apparatus 100, the right shaft 166 pulls forward on the intermediate portion 195 of the right strap 190, which is routed in a manner that requires the right foot skate 180 to move rearward twice as much as the right shaft 166 moves forward; and similarly on the left side of the apparatus 100, movement of the left shaft 166 one inch rearward coincides with movement of the left skate 180 two inches forward. In other words, each skate 180 travels fore and aft through a range of motion equal to four times the radial displacement between the axle 164 and a respective shaft 166. Those skilled in the art will recognize that the straps 190 could be routed in other ways to obtain different ratios between foot skate travel and the effective crank radius. Those skilled in the art will also recognize that the components of the linkage assembly 150 may also be arranged in other ways relative to one another without altering the ratio between foot skate travel and the effective crank radius.

A third flexible member or cord 220 is interconnected between the left skate 180 and the right skate 180 to constrain them to move in reciprocating fashion along their respective tracks 200. In particular, a first end 222 of the cord 220 is connected to the right skate 180. An intermediate portion 224 of the cord 220 extends to and about a post 202, extending downward from the right rail 200 proximate the forward end 203 thereof, then to and about a post 202, extending downward from the left rail 200 proximate the forward end 203 thereof. Those skilled in the art will recognize that rollers could be mounted on the posts 202 to facilitate movement of the cord 220 relative thereto. A second, opposite end 226 of the cord 220 is connected to the left skate 180. A spring 229 is placed in series with each end 224 and 226 of the cord 220 to keep the cord 220 taut while also allowing sufficient freedom of movement during operation.

Recognizing that the flexible members 220 and 190 cooperate to link the skates 180 to one another and to the cranks 160, the cord 220 may be said to provide a means for interconnecting the skates 180, and the straps 190 may be said to provide a link between and/or a means for interconnecting the skates 180 and the cranks 160.

For ease of reference in both this detailed description and the claims set forth below, components are sometimes described with reference to "ends" having a particular characteristic and/or being connected to another part. For example, the cord 220 may be said to have a first end connected to the right skate and a second end connected to the left skate. However, those skilled in the art will recognize that the present invention is not limited to links or members which terminate immediately beyond their points of connection with other parts. Thus, the term "end" should be interpreted broadly, in a manner that includes "rearward portion" and/or "behind an intermediate portion", for instance. For example, a single flexible member could be used in place of the two straps 200 and the one cord 220, with intermediate portions thereof rigidly secured to the foot skates.

Figure 5:
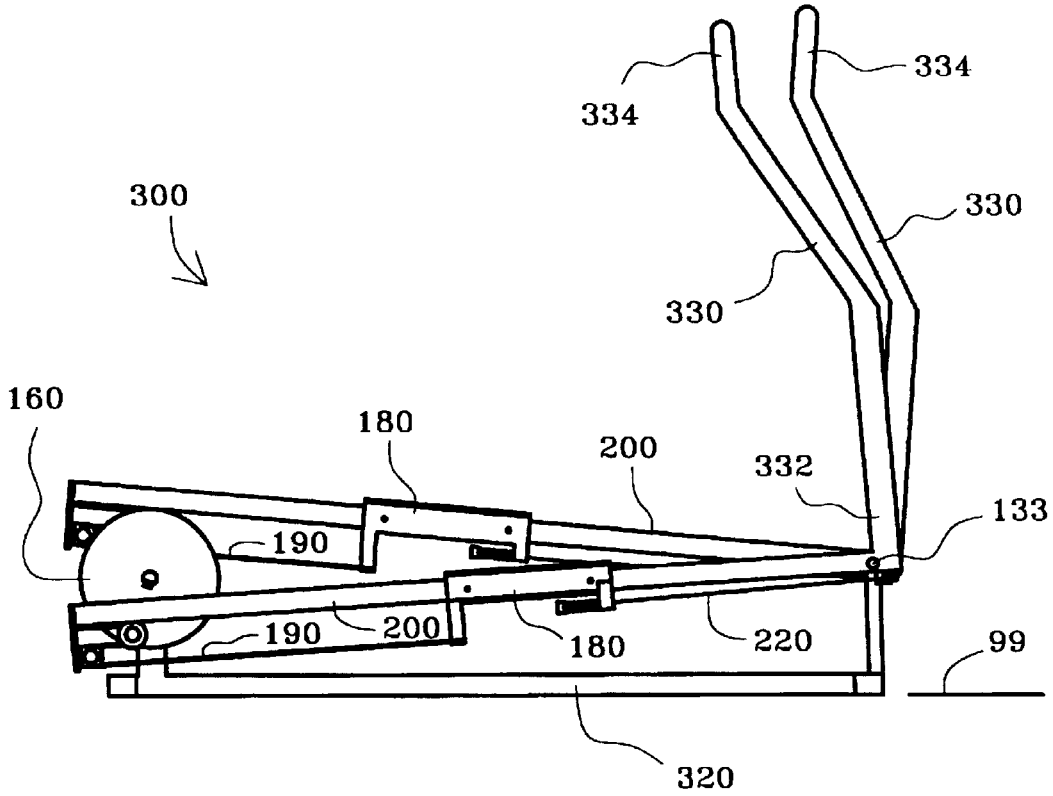
FIG. 5 is a side view of an alternative embodiment to the exercise apparatus of FIG. 1, with portions broken away beneath the foot skates to show coil springs.

The embodiment 100 provides leg exercise motion together with the option of independent arm exercise motion. However, linked or interconnected leg and arm exercise motions are also available in accordance with the present invention. For example, in FIG. 5, an exercise apparatus 300 provides leg exercise motion identical to that of the first apparatus 100. Among other things, the front ends of the rails 200 are likewise pivotally mounted to the frame 320 by means of the shaft 133. However, the apparatus 300 has handle members 330 which are rigidly secured to the rails 200, rather than rotatably mounted directly to the frame. In particular, each of the handle members 330 extends from a first or lower end 332, which is welded to the front end of the rail 200, to a second or upper end 334, which is sized and configured for grasping by a person standing on the skates 180. As a result, the handle ends 334 are constrained to pivot back and forth as the rails 200 pivot up and down.

Figure 6:
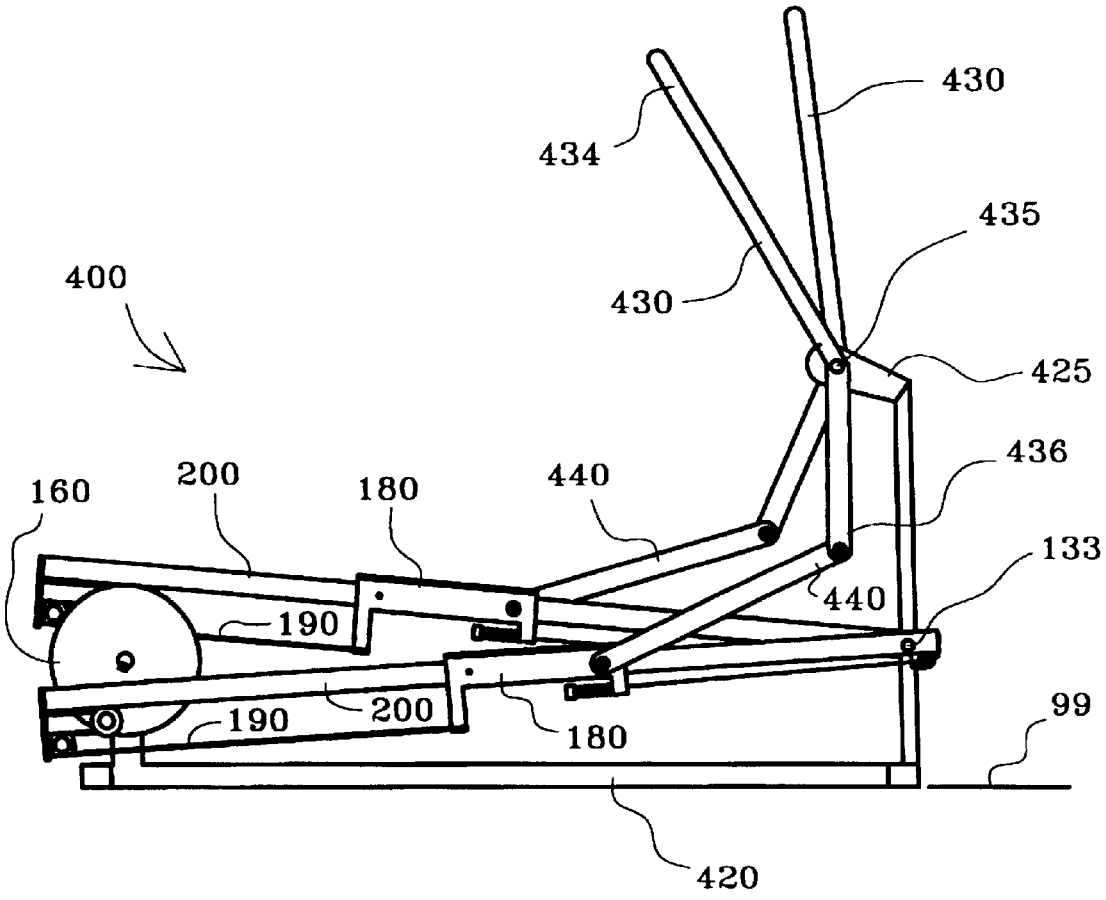
FIG. 6 is a side view of another alternative embodiment to the exercise apparatus of FIG. 1, with portions broken away beneath the foot skates to show coil springs.

Another "linked" embodiment of the present invention is designated as 400 in FIG. 6. The exercise apparatus 400 provides leg exercise motion identical to that of the first apparatus 100. Among other things, the front ends of the rails 200 are likewise pivotally mounted to the frame 420 by means of the shaft 133 at a first elevation above the floor surface 99. Each handle member 430 has an intermediate portion 435 which is pivotally connected to a trunnion 425 disposed on the frame 420 at a second, relatively greater elevation above the floor surface 99. An upper, distal portion 434 of each handle member 430 is sized and configured for grasping by a person standing on the force receiving member 180. A lower, distal portion 436 of each handle member 430 is rotatably connected to one end of a handle link 440. An opposite end of the handle link 440 is rotatably connected to the force receiving member 180. As a result, the handle members 430 are constrained to pivot back and forth as the force receiving members 180 move through a generally elliptical path of motion.

Figure 7:
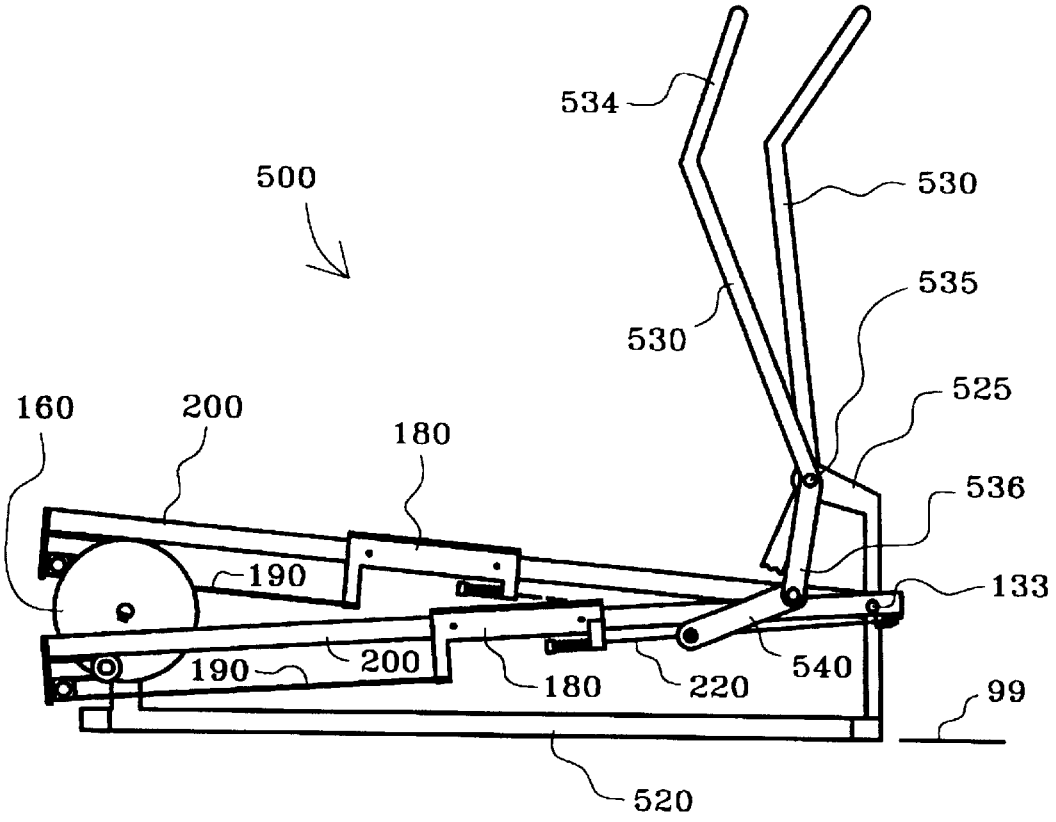
FIG. 7 is a side view of yet another alternative embodiment to the exercise apparatus of FIG. 1, with portions broken away beneath the foot skates to show coil springs.

Yet another "linked" embodiment of the present invention is designated as 500 in FIG. 7. The exercise apparatus 500 provides leg exercise motion identical to that of the first apparatus 100, and among other things, the front ends of the rails 200 are likewise pivotally mounted to the frame 520 by means of the shaft 133 at a first elevation above the floor surface 99. Each handle member 530 has an intermediate portion 535 which is pivotally connected to a trunnion 525 disposed on the frame 520 at a second, relatively greater elevation above the floor surface 99. An upper, distal portion 534 of each handle member 530 is sized and configured for grasping by a person standing on the force receiving member 180. A lower, distal portion 536 of each handle member 530 is rotatably connected to one end of a handle link 540. An opposite end of the handle link 540 is fixedly secured to the cord 220. As a result, the handle members 530 are constrained to pivot back and forth as the juncture points on the cord 220 move through a generally elliptical path of motion.

Figure 8:
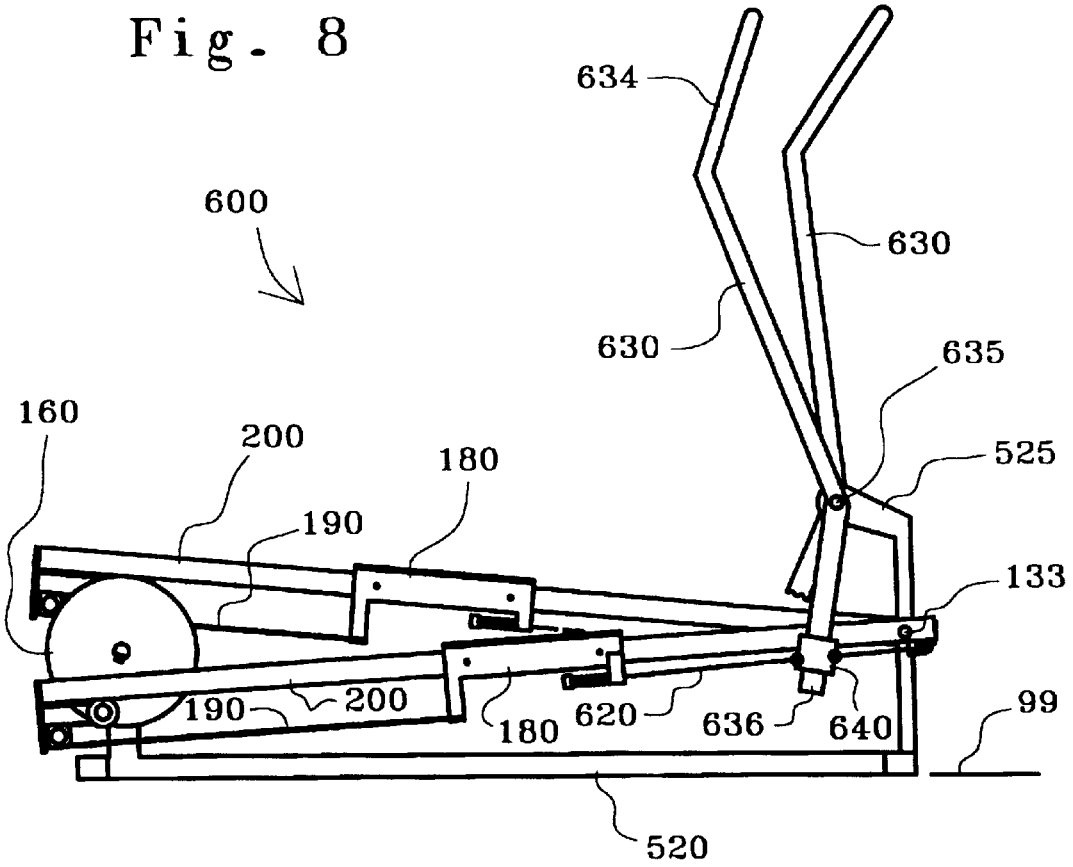
FIG. 8 is a side view of still another alternative embodiment of the exercise apparatus of FIG. 1, with portions broken away beneath the foot skates and proximate the lower end of one handle for purposes of clarity.

Still another "linked" embodiment of the present invention is designated as 600 in FIG. 8. The exercise apparatus 600 provides leg exercise motion identical to that of the first apparatus 100. Among other things, the front ends of the rails 200 are likewise pivotally mounted to the frame 520 by means of the shaft 133 at a first elevation above the floor surface 99. Each handle member 630 has an intermediate portion 635 which is pivotally connected to a trunnion 525 disposed on the frame 520 at a second, relatively greater elevation above the floor surface 99. An upper, distal portion 634 of each handle member 630 is sized and configured for grasping by a person standing on the force receiving member 180. A lower, distal portion 636 of each handle member 630 extends into a ring 640 which, in turn, is fixedly secured to the cord 620. Those skilled in the art will recognize that the cord 620 may be a single cord or three separate pieces of cord extending from one skate 180 to the other. In any event, the handle members 630 are constrained to pivot back and forth as the rings 640 move through a generally elliptical path of motion (sliding up and down along the lower portion 636 of the handle member 630).

Figure 9:
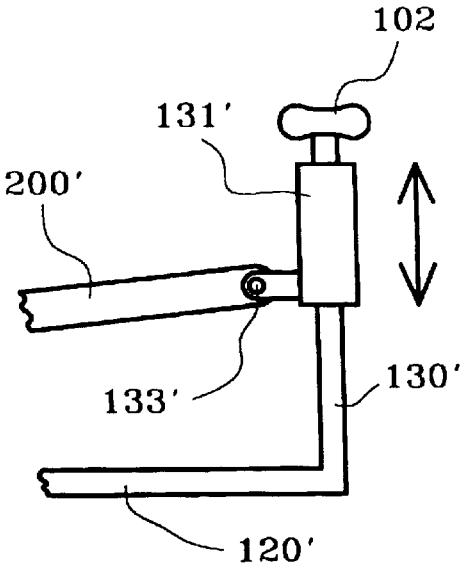
FIG. 9 is a diagrammatic side view of an elevation adjustment mechanism suitable for use on exercise apparatus constructed according to the present invention.

With any of the foregoing embodiments, the orientation of the path traveled by the force receiving members 180 may be adjusted by raising or lowering the shaft 133 relative to the floor surface 99. One such mechanism for doing so is the detent pin arrangement shown and described with reference to the first embodiment 100. Another suitable mechanism is shown diagrammatically in FIG. 9, wherein a frame 120' includes a post 131' movable along an upwardly extending stanchion 130', and a rail 200' is rotatably mounted to the post 131' by means of a shaft 133'. A knob 102 is rigidly secured to a lead screw which extends through the post 131' and threads into the stanchion 130'. The knob 102 and the post 131' are interconnected in such a manner that the knob 102 rotates relative to the post 131', but they travel up and down together relative to the stanchion 130' (as indicated by the arrows).

Figure 10:
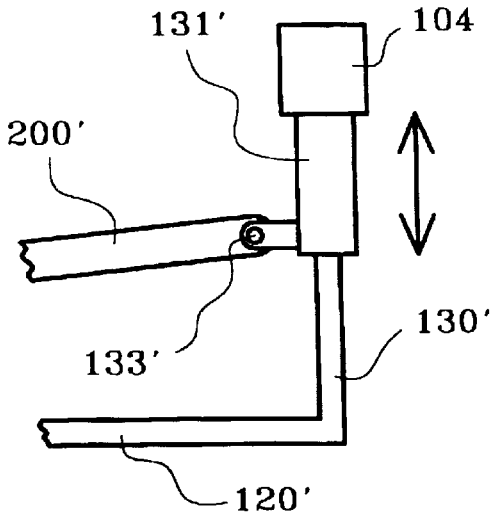
FIG. 10 is a diagrammatic side view of another elevation adjustment mechanism suitable for use on exercise apparatus constructed according to the present invention.
Figure 11:
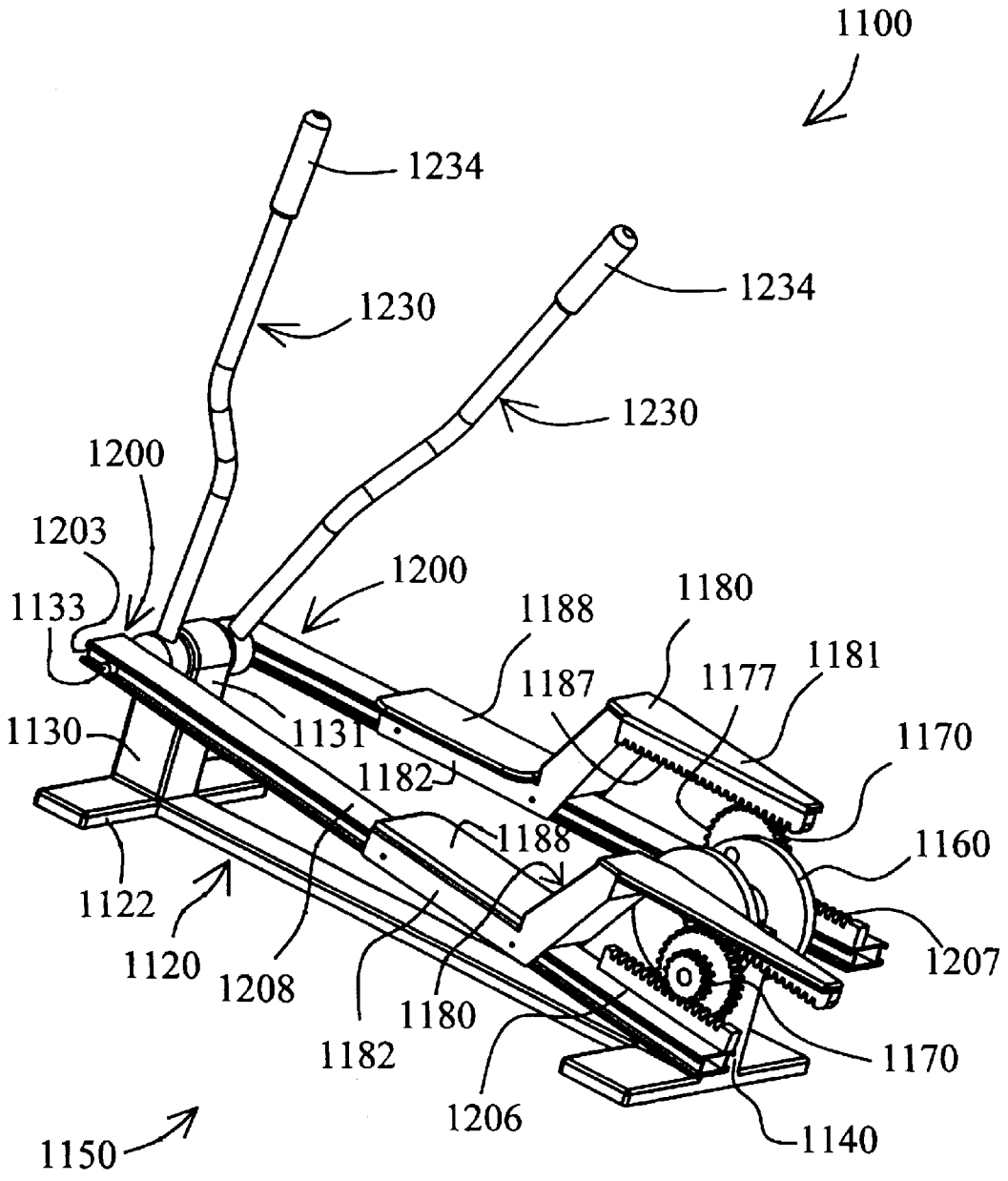
FIG. 11 is a perspective view of yet another exercise apparatus constructed according to the principles of the present invention.

Yet another suitable adjustment mechanism is shown diagrammatically in FIG. 10, wherein again, a frame 120' includes a post 131' movable along an upwardly extending stanchion 130', and a rail 200' is rotatably mounted to the post 131' by means of a shaft 133'. An actuator 104, such as a motor or a hyrdaulic drive, is rigidly secured to the post 131' and connected to a shaft which extends through the post 131' and into the stanchion 130'. The actuator 104 selectively moves the shaft relative to the post 131', causing the actuator 104 and the post 131' to travel up and down together relative to the stanchion 130' (as indicated by the arrows). The actuator 104 may operate in response to signals from a person and/or a computer controller.

Another exercise apparatus constructed according to the principles of the present invention is designated as 1100 in FIGS. 11–15. The apparatus 1100 generally includes a frame 1120 and a linkage assembly 1150 movably mounted on the frame 1120. Generally speaking, the linkage assembly 1150 moves relative to the frame 1120 in a manner that links rotation of a flywheel 1160 to generally elliptical motion of a force receiving member 1180. The term "elliptical motion" is intended in a broad sense to describe a closed path of motion having a relatively longer first axis and a relatively shorter second axis (which extends perpendicular to the first axis).

The frame 1120 includes a base 1122, a forward stanchion or upright 1130, and a rearward stanchion or upright 1140. The base 1122 may be described as generally I-shaped and is designed to rest upon a generally horizontal floor surface 99 (see FIGS. 12 and 14–15). The apparatus 1100 is generally symmetrical about a vertical plane extending lengthwise through the base 1122 (perpendicular to the transverse ends thereof), the only exception being the relative orientation of certain parts of the linkage assembly 1150 on opposite sides of the plane of symmetry. In the embodiment 1100, the "right-hand" components are one hundred and eighty degrees out of phase relative to the "left-hand" components. However, like reference numerals are used to designate both the "right-hand" and "left-hand" parts on the apparatus 1100, and when reference is made to one or more parts on only one side of the apparatus, it is to be understood that corresponding part(s) are disposed on the opposite side of the apparatus 1100. Those skilled in the art will also recognize that the portions of the frame 1120 which are intersected by the plane of symmetry exist individually and thus, do not have any "opposite side" counterparts. Furthermore, to the extent that reference is made to forward or rearward portions of the apparatus 1100, it is to be understood that a person could exercise on the apparatus 1100 while facing in either direction relative to the linkage assembly 1150.

The forward stanchion 1130 extends perpendicularly upward from the base 1122 and supports a telescoping tube 1131. A plurality of holes 1138 are formed in the stanchion 1130, and at least one hole is formed in the upper end of the tube 1131 to selectively align with any one of the holes 1138. A pin 1128, having a ball detent, may be inserted through an aligned set of holes to secure the tube 1131 in a raised position relative to the stanchion 1130.

The rearward stanchion 1140 extends perpendicularly upward from the base 1122 and supports a bearing assembly. An axle 1164 is inserted through a laterally extending hole in the bearing assembly to support a pair of flywheels 1160 in a manner known in the art. For example, the axle 1164 may be inserted through the hole, and then a flywheel 1160 may be keyed to each of the protruding ends of the axle 1164, on opposite sides of the stanchion 1140. Those skilled in the art will recognize that the flywheels 1160 could be replaced by some other rotating member(s) which may or may not, in turn, be connected to one or more flywheels. These rotating members 1160 rotate about a crank axis which coincides with the longitudinal axis of the axle 1164.

A radially displaced shaft or support 1166 is rigidly secured to each flywheel 1160 by means known in the art. For example, the shaft 1166 may be inserted into a hole in the flywheel 1160 and welded in place. The shaft 1166 extends axially away from the flywheel 1160 at a point radially displaced from the crank axis, and thus, the shaft 1166 rotates at a fixed radius about the crank axis. In other words, the shaft 1166 and the flywheel 1160 cooperate to define a crank having a crank radius.

Figure 14:
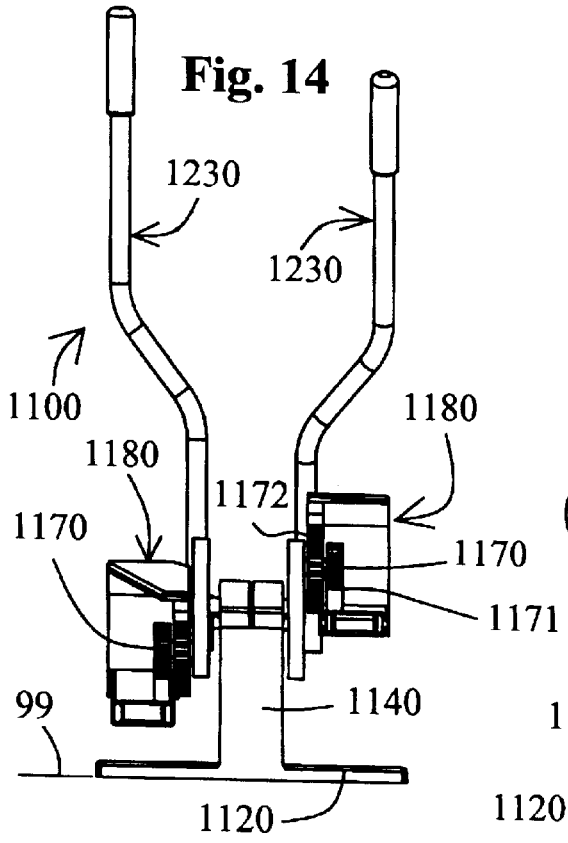
FIG. 14 is a rear view of the exercise apparatus of FIG. 11.
Figure 15:
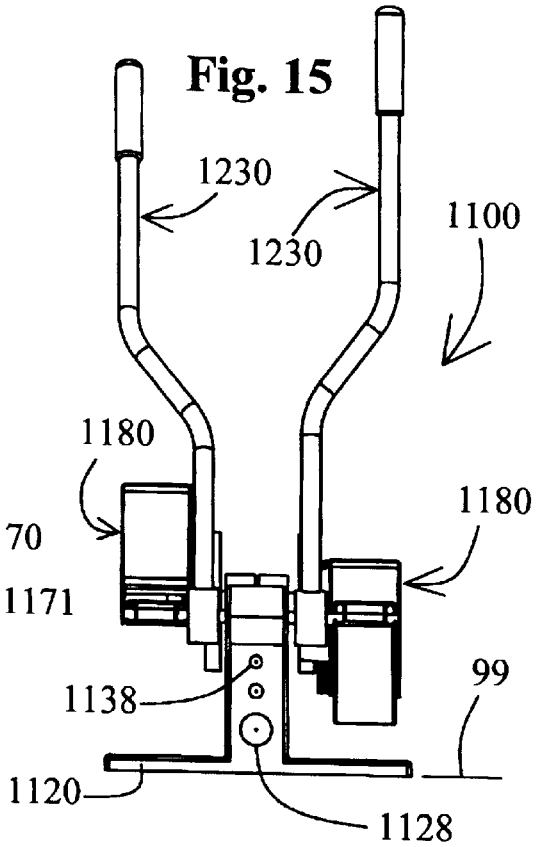
FIG. 15 is a front view of the exercise apparatus of FIG. 11.

A roller 1170 is rotatably mounted on each shaft 1166. The roller 1170 on the right side of the apparatus 1100 rotates about a roller axis which coincides with the longitudinal axis of the right shaft 1166, and the roller 1170 on the left side of the apparatus 1100 rotates about a roller axis which coincides with the longitudinal axis of the left shaft 1166. As shown in FIG. 14, the roller 1170 provides a first interface 1171 having a first effective diameter, and a second interface 1172 having a second, relatively smaller effective diameter. In this embodiment 100, gear teeth 1177 are disposed about the roller 1170 at the first interface 1171, and gear teeth 1178 are disposed about the roller 1170 at the second interface 1172.

Each force receiving member 1180 has a rearward portion or arm 1181 which overlies the first interface 1171. In this embodiment 100, a rack of gear teeth 1187 is disposed along the rearward portion 1181 and engages the gear teeth 1177 on the roller interface or pinion 1171. In view of this arrangement, the roller 1170 may be said to provide a means for interconnecting the flywheel 1160 and the force receiving member 1180. Each force receiving member 1180 has a forward portion 1182 which is rollably mounted on a respective rail or track 1200 in a manner known in the art. Each force receiving member 1180 provides an upwardly facing support surface 1188 sized and configured to support a person's foot. Thus, each force receiving member 1180 may be described as a foot skate.

Each rail 1200 has a forward end 1203, a rearward end 1206, and an intermediate portion 1208. The forward end 1203 of each rail 1200 is movably connected to the frame 1120, forward of the flywheels 1160. In particular, each forward end 1203 is rotatably connected to the forward stanchion 1130 by means known in the art. For example, a shaft 1133 may be inserted into a hole extending laterally through the tube 1131 and into holes extending laterally through the forward ends 1203 of the rails 1200. The shaft 1133 may be keyed in place relative to the stanchion 1130, and nuts may be secured to opposite ends of the shaft 1133 to retain the forward ends 1203 on the shaft 1133. As a result of this arrangement, the rail 1200 may be said to provide a discrete means for movably interconnecting the force receiving member 1180 and the frame 1120.

The rearward end 1206 of the rail 1200 underlies the second interface 1172 on the roller 1170. In this embodiment 1100, a rack of gear teeth 1207 is disposed along the rearward portion 1206 and engages the gear teeth 1178 on the roller interface or pinion 1172. In view of this arrangement, the roller 1170 may be said to provide a means for movably interconnecting the flywheel 1160 and the rail 1200, and the rail 1200 may be said to provide a discrete means for movably interconnecting the flywheel 1160 and the force receiving member 1180.

The intermediate portion 1208 of the rail 1200 may be defined as that portion of the rail 1200 along which the skate 1180 may travel and/or as that portion of the rail 1200 between the rearward end 1206 (which rolls over the roller 1170) and the forward end 1203 (which is rotatably mounted to the frame 1120). The intermediate portion 1208 may be generally described as having an I-shaped profile and/or a pair of C-shaped channels which open away from one another. Each channel 1209 functions as a guide for one or more rollers rotatably mounted on each side of the foot skate 1180. The skate 1180 cooperates with the roller 1170 to support the rear end 1206 of the rail 1200 above the floor surface 99.

Figure 12:
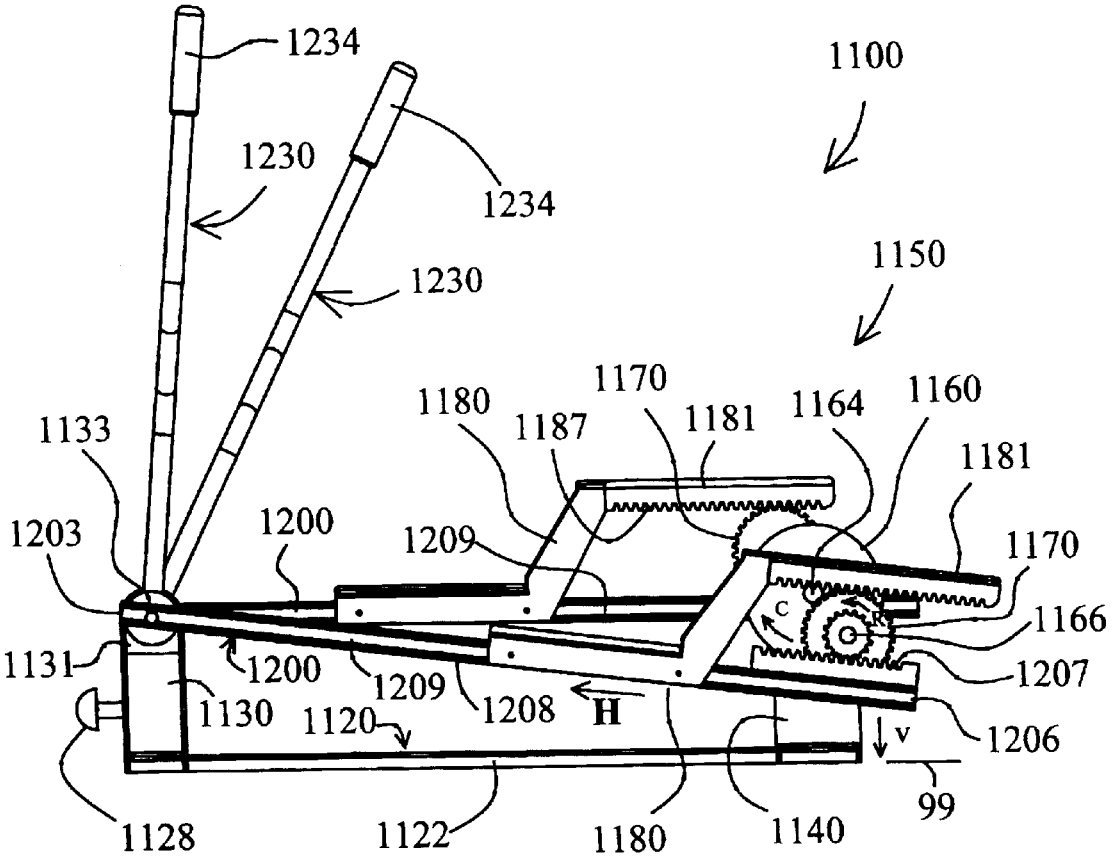
FIG. 12 is a side view of the exercise apparatus of FIG. 11.
Figure 13:
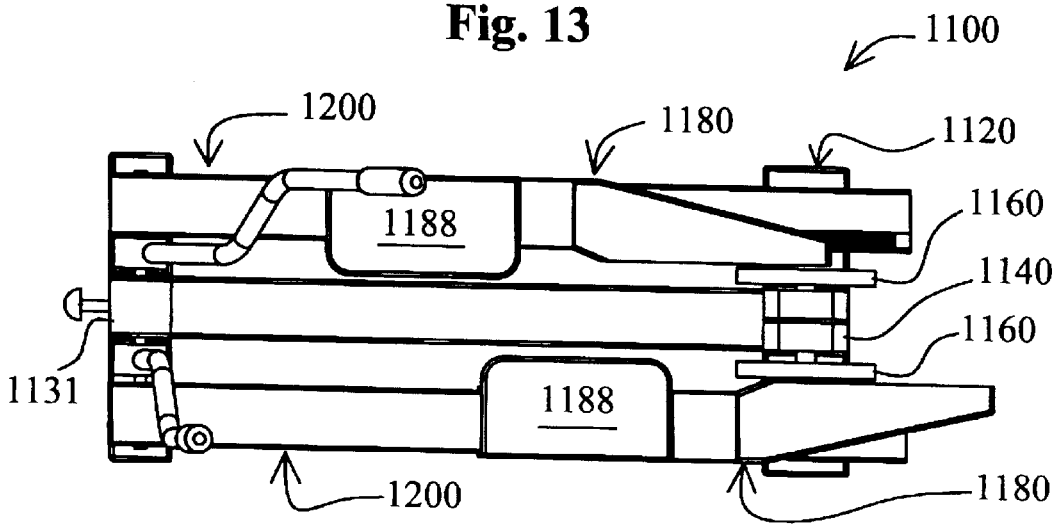
FIG. 13 is a top view of the exercise apparatus of FIG. 11.

Operation of the apparatus 1100 may be described with reference to FIG. 12, wherein arrows H, R, V, and C indicate how respective parts of the linkage assembly 1150 move relative to the frame 1120 and one another. The rack 1187 and pinion 1177 link movement of the force receiving member 1180 in the direction H to rotation of the roller 1170 in the direction R. The rail 1200 cannot move in the direction H because of its connection to the forward stanchion 1130. Thus, the force receiving member 1180 moves in the direction H relative to both the frame 1120 and the rail 1200. The rack 1207 and pinion 1178 link rotation of the roller 1170 in the direction R to forward movement of the roller 1170 along the rail 1200. In turn, the shaft 1166 links forward movement of the roller 1170 along the rail 1200 to rotation of the crank 1160 in the direction C. Since the rear portions of the force receiving member 1180 and the rail 1200 are supported by the roller 1170, rotation of the crank 1160 in the direction C is linked to movement of the force receiving member 1180 and the rail 1200 in the direction V.

Those skilled in the art will recognize that the extent or range of motion of the force receiving member 1180 in the direction V cannot exceed twice the radial distance between the crank axis and the roller axis. However, the extent or range of motion of the force receiving member 1180 in the direction H is a function of the diameter or gear ratio defined by the interfaces 1171 and 1172 and may exceed twice the radial distance between the crank axis and the roller axis. In the embodiment 1100, the range of motion in the direction H is approximately four times the noted radial distance.

Handle members 1230 are rotatably mounted to the frame 1120 in a manner known in the art to provide the option of exercising the upper body contemporaneously with exercise of the lower body. In particular, a lower end of each of the handle members 1230 is rotatably mounted on the shaft 1133 between the tube 1131 and a respective rail 1200. In this embodiment 1100, the handle members 1230 are independently movable relative to one another and the post 1131. Resistance to handle pivoting may be provided in the form of friction discs or by other means known in the art. Each handle member 1230 also includes an upper, distal portion 1234 which is sized and configured for grasping by a person standing on the force receiving member 1180.

Figure 16:
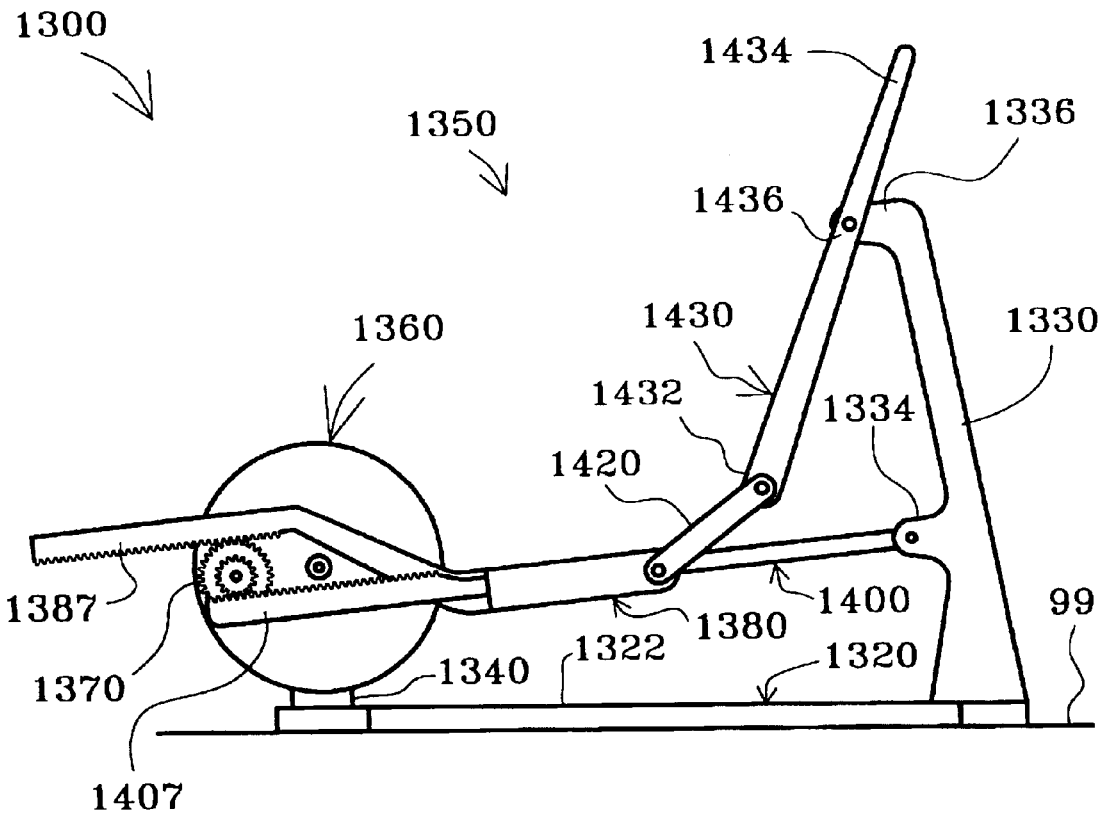
FIG. 16 is a side view of an alternative embodiment to the exercise apparatus of FIG. 1, with only one side of the linkage assembly shown.

An alternative to the embodiment 1100 is designated as 1300 and shown diagrammatically in FIG. 16. The embodiment 1300 is similar in many respects to the embodiment 1100 but has a handle member 1430 which is linked to a force receiving member 1380. Generally speaking, the handle member 1430 and the force receiving member 1380 are components of a linkage assembly 1350 which is movably connected to a frame 1320. The frame 1320 includes a base 1322, which rests upon a floor surface 99, a forward stanchion 1330, which extends upward from the front end of the base 1322, and a rearward stanchion 1340, which extends upward from the rear end of the base 1322.

A flywheel 1360 is rotatably mounted on the rearward stanchion 1340 and rotatable about a crank axis. A roller 1370 is rotatably mounted on the flywheel 1360 at a location radially displaced from the crank axis and cooperates with the flywheel 1360 to define a crank. The roller 1370 rotates about a roller axis relative to the flywheel 1360 and rotates with the flywheel 1360 about the crank axis. A first set of gear teeth, disposed at a relatively greater diameter about the roller 1370, engages a rack 1387 of gear teeth on the force receiving member 1380. A second set of gear teeth, disposed at a relatively smaller diameter about the roller 1370, engages a rack 1407 of gear teeth on a support member 1400. An opposite end of the support member 1400 is pivotally connected to a first trunnion 1334 on the forward stanchion 1330. The force receiving member 1380 is movably mounted on the support member 1400 intermediate the rack 1407 and the trunnion 1334.

A link 1420 is rotatably interconnected between the force receiving member 1380 and a lower end 1432 of a handle member 1430. An opposite, upper end 1434 of the handle member 1430 is sized and configured for grasping by a person standing on the force receiving member 1380. An intermediate portion 1436 of the handle member 1430 is pivotally mounted to a second, relatively higher trunnion 1336 on the forward stanchion 1330. The link 1420 links generally elliptical movement of the force receiving member to pivoting of the handle member 1430.

Figure 17:
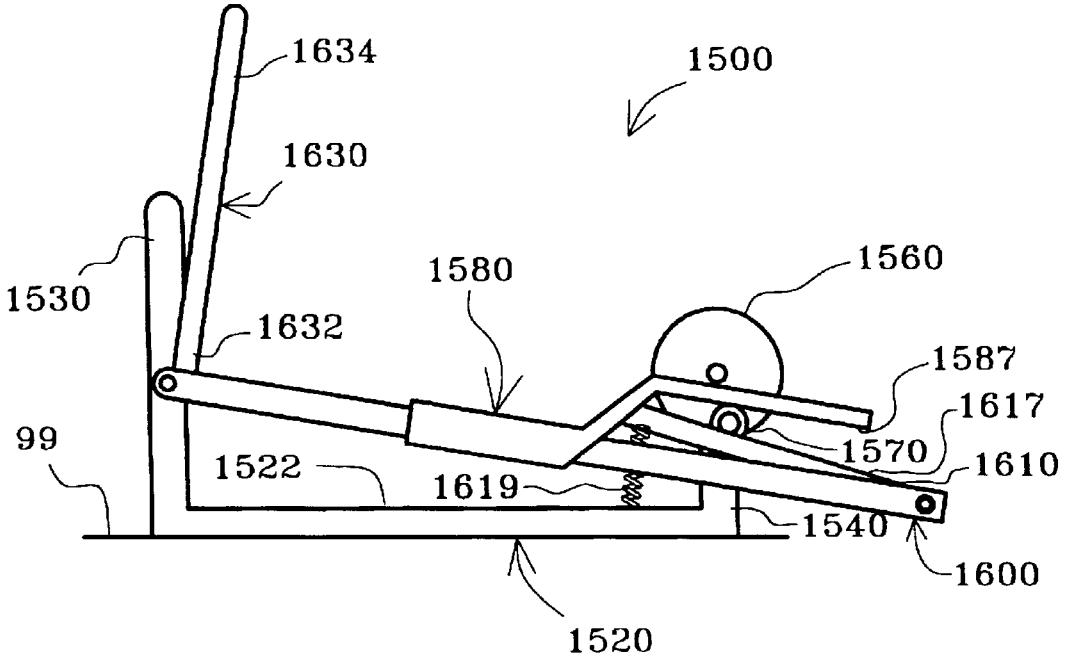
FIG. 17 is a side view of another alternative embodiment to the exercise apparatus of FIG. 1, with only one side of the linkage assembly shown.

Additional possible modifications involving the present invention may described with reference to the embodiment designated as 1500 in FIG. 17. Generally speaking, the exercise apparatus 1500 includes a frame 1320 having a base 1522, which rests upon a floor surface 99, a forward stanchion 1530, which extends upward from the front end of the base 1522, and a rearward stanchion 1540, which extends upward from the rear end of the base 1522.

A flywheel 1560 is rotatably mounted on the rearward stanchion 1540 and rotatable about a crank axis. A roller 1570 is rotatably mounted on the flywheel 1560 at a location radially displaced from the crank axis and cooperates with the flywheel 1560 to define a crank. The roller 1570 rotates about a roller axis relative to the flywheel 1560 and rotates with the flywheel 1560 about the crank axis. Rather than gear teeth, the roller 1570 simply has a first bearing surface or interface, disposed at a relatively greater diameter about the roller 1570, which engages a flat bearing surface 1587 on the force receiving member 1580, and a second bearing surface or interface, disposed at a relatively smaller diameter about the roller 1570, which engages a flat bearing surface 1617 on a support member 1600.

A rearward end of the support member 1610 is rotatably connected to a rearward end of a rail 1600. A helical coil spring 1619 is disposed between the base 1522 and an opposite, forward end of the support member 1610. The spring 1619 biases the bearing surface 1617 upward against the roller 1570. An opposite, forward end of the rail 1600 is rotatably connected to the forward stanchion 1530. The force receiving member 1580 is movably mounted on the rail 1600 intermediate the forward end and the rearward end. The rearward end of the rail 1600 is supported by the force receiving member 1580 which, in turn, is supported by the roller 1570.

A handle member 1630 has a lower end 1632 which is rigidly secured to the forward end of the rail 1600. An opposite, upper end 1634 of the handle member 1630 is sized and configured for grasping by a person standing on the force receiving member 1580. As a result of this arrangement, the handle member 1630 pivots together with the rail 1600 relative to the frame 1520.

Figure 20:
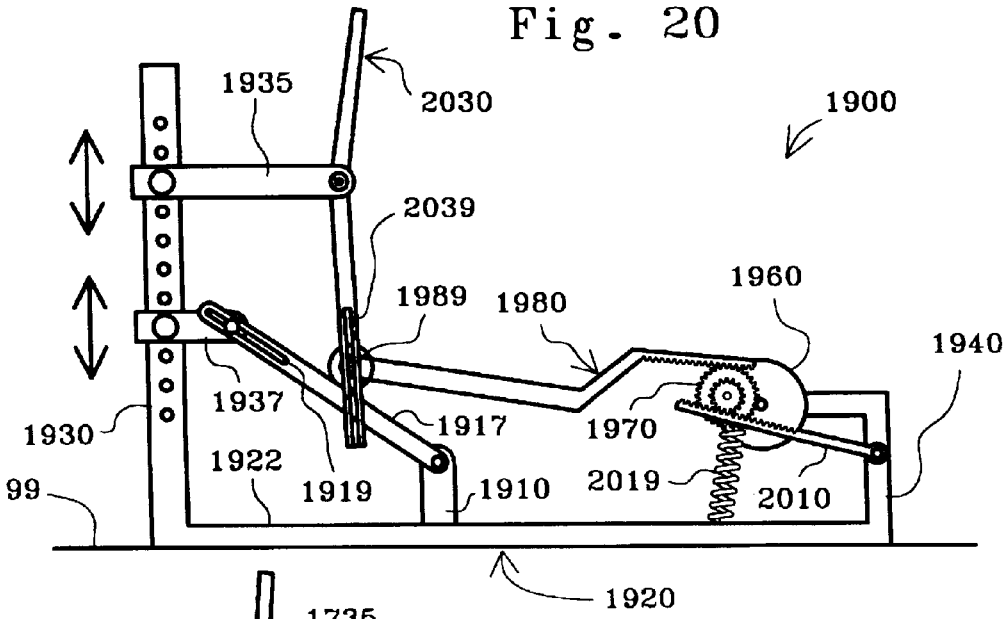
FIG. 20 is a side view of yet one more alternative embodiment to the exercise apparatus of FIG. 1, with only one side of the linkage assembly shown.
Figure 19:
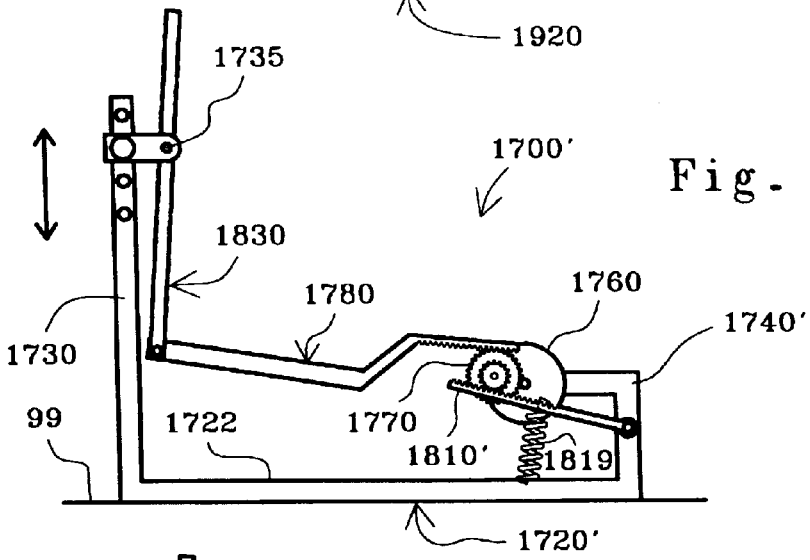
FIG. 19 is a side view of still another alternative embodiment to the exercise apparatus of FIG. 1, with only one side of the linkage assembly shown.
Figure 18:
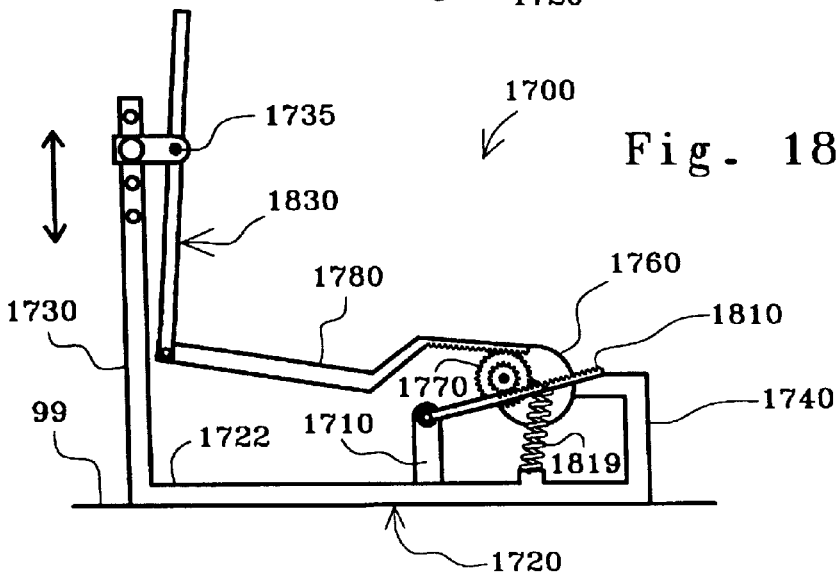
FIG. 18 is a side view of yet another alternative embodiment to the exercise apparatus of FIG. 1, with only one side of the linkage assembly shown.

Additional embodiments of the present invention are shown diagrammatically in FIGS. 18–20. The exercise apparatus designated as 1700 in FIG. 18 includes a frame 1720 having a base 1722, a forward stanchion 1730, a rearward stanchion 1740, and an intermediate stanchion 1710. A flywheel 1760 is rotatably mounted on the rearward stanchion 1740, and a roller 1770 is rotatably mounted on the flywheel 1760 at a radially displaced location. A first set of gear teeth, disposed at a relatively greater diameter about the roller 1770, engages a rack of gear teeth on a rearward portion of a force receiving member 1780. A second set of gear teeth, disposed at a relatively smaller diameter about the roller 1770, engages a rack of gear teeth on a support member 1810. A forward end of the support member 1810 is rotatably connected to the intermediate stanchion 1710. A helical coil spring 1819 is disposed between the base 1722 and the support member 1710 to bias the bearing surface on the latter upward against the roller 1770.

A forward end of the force receiving member 1780 is rotatably connected to a lower end of a handle member 1830. An opposite, upper end of the handle member 1830 is sized and configured for grasping by a person standing on the force receiving member 1780. An intermediate portion of the handle member 1830 is rotatably connected to a trunnion 1735 which, in turn, is slidably mounted on the forward stanchion 1730. A pin may be selectively inserted through aligned holes in the trunnion 1735 and the stanchion 1730 to secure the trunnion 1735 in any of several positions above the floor surface. As a result of this arrangement, pivoting of the handle member 1830 relative to the trunnion 1735 is linked to generally elliptical movement of the force receiving member 1780 relative to the frame 1720, which is linked to rotation of the flywheel 1760 relative to the frame 1720, which is linked to pivoting of the support member 1810 relative to the frame 1720.

As suggested by the many like reference numerals, the exercise apparatus designated as 1700' in FIG. 19 is similar in many respects to the apparatus designated as 1700 in FIG. 18. However, because the frame 1720' does not include an intermediate stanchion, the support member 1810' is reversed, and the rearward end thereof is rotatably mounted to the rearward stanchion 1740'.

The exercise apparatus designated as 1900 in FIG. 20 includes a frame 1920 having a base 1922, a forward stanchion 1930, a rearward stanchion 1940, and an intermediate stanchion 1910. A flywheel 1960 is rotatably mounted on the rearward stanchion 1940, and a roller 1970 is rotatably mounted on the flywheel 1960. A first set of gear teeth, disposed at a relatively greater diameter about the roller 1970, engages a rack of gear teeth on a rearward portion of a force receiving member 1980. A second set of gear teeth, disposed at a relatively smaller diameter about the roller 1970, engages a rack of gear teeth on a support member 2010. A rearward end of the support member 2010 is rotatably connected to the rearward stanchion 1940. A helical coil spring 2019 is disposed between the base 1922 and the support member 2010 to bias the latter upward against the roller 1970.

A roller 1989 is rotatably mounted on a forward end of the force receiving member 1980. The roller 1989 rolls or bears against a ramp 1917 having a first end rotatably connected to the intermediate stanchion 1910, and a second, opposite end connected to a trunnion 1937. A slot 1919 is provided in the ramp 1917 to accommodate angular adjustment of the ramp 1917 relative to the trunnion 1937 and the floor surface 99. In particular, the trunnion 1937 is slidably mounted on the forward stanchion 1930, and a pin may be selectively inserted through aligned holes in the trunnion 1937 and the stanchion 1930 to secured the stanchion 1937 in any of several positions above the floor surface. As the trunnion 1937 slides downward, the fastener interconnecting the trunnion 1937 and the ramp 1917 moves within the slot 1919.

A lower portion of a handle member 2030 is movably connected to the forward end of the force receiving member 1980, adjacent the roller 1989. In particular, a common shaft extends through the force receiving member 1980, the roller 1989, and a slot 2039 provided in the lower portion of the handle member 2030. An opposite, upper end of the handle member 2030 is sized and configured for grasping by a person standing on the force receiving member 1980. An intermediate portion of the handle member 2030 is rotatably connected to a trunnion 1935 which, in turn, is slidably mounted on the forward stanchion 1930 above the trunnion 1937. A pin may be selectively inserted through aligned holes in the trunnion 1935 and the stanchion 1930 to secure the trunnion 1935 in any of several positions above the floor surface. The slot 2039 in the handle member 2030 accommodates height adjustments and allows the handle member 2030 to pivot about its connection with the trunnion 2035 while the roller 1989 moves through a linear path of motion. As a result of this arrangement, the height of the handle member 2030 can be adjusted without affecting the path of the foot support 1980, and/or the path of the foot support 1980 can be adjusted without affecting the height of the handle member 2030, even though the two force receiving members are linked to one another.

Some additional modifications to the present invention are shown diagrammatically in FIGS. 21–26. Each of the embodiments 2100, 2200, 2300, 2400, 2500, and 2600 is shown with a linkage assembly in the absence of a frame. In each case, a flywheel 2160 is rotatably mounted on the frame, and a roller 2170 is rotatably mounted on the flywheel 2160 at a radially displaced location. A first roller interface engages a rear portion of a force receiving member 2180, and a second roller interface engages a support member 2190. The support member 2190 is rotatably connected to the frame and biased toward the roller 2170 by spring 2199. A roller 2189 is rotatably mounted on a forward end of the force receiving member 2180.

Figure 21:
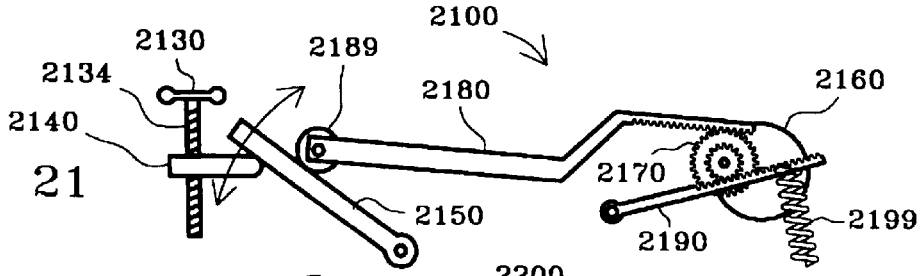
FIG. 21 is a diagrammatic side view of a first alternative arrangement for movably and adjustably connecting the force receiving member to the frame.

In the embodiment 2100 of FIG. 21, the roller 2189 rolls or bears against a flat or linear bearing surface on a ramp 2150. A relatively lower and rearward end of the ramp 2150 is rotatably connected to the frame, and a relatively higher and forward end of the ramp 2150 is supported by a flange or ledge 2140. A threaded hole is formed through the flange 2140 to accommodate a lead screw 2134 having a lower end rotatably connected relative to the frame. A knob 2130 on the lead screw 2134 is rotated to move the flange 2140 up or down along the lead screw 2134 and relative to the frame and thereby adjust the inclination of the ramp 2150 relative to the frame and the floor surface.

Figure 22:
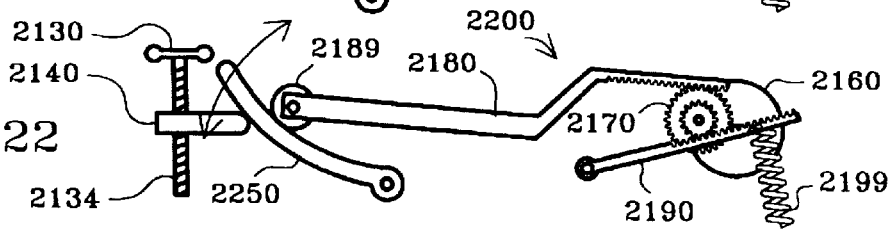
FIG. 22 is a diagrammatic side view of a second alternative arrangement for movably and adjustably connecting the force receiving member to the frame.

In the embodiment 2200 of FIG. 22, the roller 2189 rolls or bears against an arcuate or upwardly concave bearing surface on a ramp 2250. A relatively lower and rearward end of the ramp 2250 is rotatably connected to the frame, and a relatively higher and forward end of the ramp 2250 is supported by a flange or ledge 2140. The same lead screw arrangement is provided to adjust the inclination of the ramp 2250 relative to the frame and the floor surface.

Figure 23:
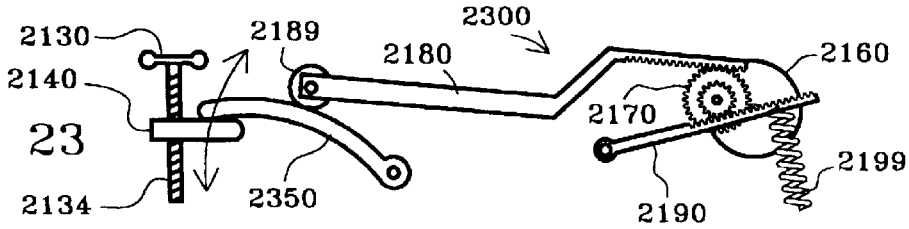
FIG. 23 is a diagrammatic side view of a third alternative arrangement for movably and adjustably connecting the force receiving member to the frame.

In the embodiment 2300 of FIG. 23, the roller 2189 rolls or bears against an arcuate or upwardly convex bearing surface on a ramp 2350. A relatively lower and rearward end of the ramp 2350 is rotatably connected to the frame, and a relatively higher and forward end of the ramp 2350 is supported by a flange or ledge 2140. The same lead screw arrangement is provided to adjust the inclination of the ramp 2350 relative to the frame and the floor surface.

Figure 24:
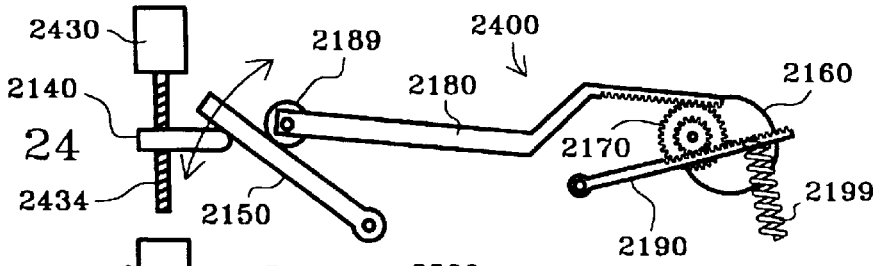
FIG. 24 is a diagrammatic side view of a fourth alternative arrangement for movably and adjustably connecting the force receiving member to the frame.

In the embodiment 2400 of FIG. 24, the roller 2189 rolls or bears against the same ramp 2150 as that shown and described with reference to FIG. 21 and the embodiment 2100. However, a different arrangement is provided to adjust the inclination of the ramp 2150 relative to the frame and the floor surface. In particular, the flange 2140 is connected to a shaft 2434 on a power driven adjustment device 2430, which could be a motor, for example. The device 2430 operates to move the flange 2140 up and down relative to the frame in response to a signal from either a computer controller or a user.

Figure 25:
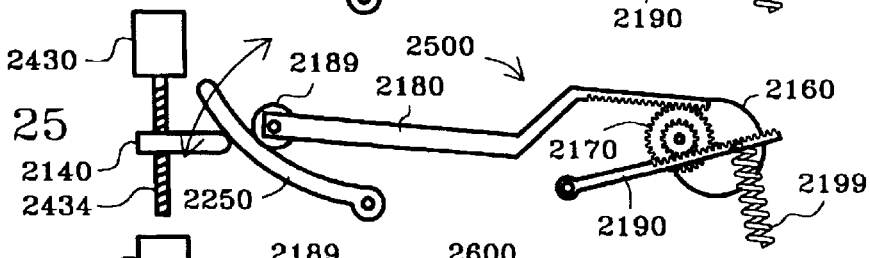
FIG. 25 is a diagrammatic side view of a fifth alternative arrangement for movably and adjustably connecting the force receiving member to the frame.

The embodiment 2500 of FIG. 25 is provided with the same ramp 2250 as that shown and described with reference to FIG. 22 and embodiment 2200, and with the same power driven adjustment arrangement as that shown and described with reference to FIG. 24 and the embodiment 2400.

Figure 26:
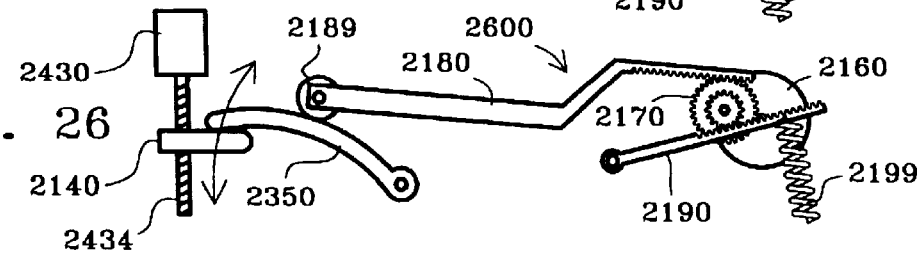
FIG. 26 is a diagrammatic side view of a sixth alternative arrangement for movably and adjustably connecting the force receiving member to the frame.

The embodiment 2600 of FIG. 26 is provided with the same ramp 2350 as that shown and described with reference to FIG. 23 and embodiment 2300, and with the same power driven adjustment arrangement as that shown and described with reference to FIG. 24 and the embodiment 2400.

Still more possible variations of the present invention are illustrated in FIGS. 27–31. In FIG. 27, an alternative roller 2770 is rotatably mounted on the flywheel 1160 of the embodiment 1100 shown in and described with reference to FIGS. 11–15. Each of the interfaces 2771 and 2772 may be described as having gear teeth disposed about an elliptical surface, wherein the major axes of the two interfaces are co-linear.

In FIG. 28, an alternative roller 2870 is rotatably mounted on the flywheel 1160 and provides interfaces 2871 and 2872 which have gear teeth disposed about elliptical surfaces. The major axes of the two interfaces 2871 and 2872 extend perpendicular to one another. Obviously, any two interfaces which are elliptical (or otherwise not entirely symmetrical) may be oriented so that the major axes occupy any angle relative to one another.

In FIG. 29, an alternative roller 2970 is rotatably mounted on the flywheel 1160 of the embodiment 1100 shown in and described with reference to FIGS. 11–15. The relatively smaller diameter interface 2971 may be described as having a smooth asymmetrical surface which provides a cam effect, and the relatively larger diameter interface 2972 may be described as having gear teeth disposed about an elliptical surface.

In FIG. 30, an alternative roller 3070 is rotatably mounted on the flywheel 1160 of the embodiment 1100 shown in and described with reference to FIGS. 11–15. The relatively smaller diameter interface 3071 may be described as having gear teeth disposed about a cylindrical surface, and the relatively larger diameter interface 3072 may be described as having a smooth asymmetrical surface which provides a cam effect.

In FIG. 31, an alternative roller 3170 is rotatably mounted on the flywheel 1160 of the embodiment 1100 shown in and described with reference to FIGS. 11–15. The two interfaces 3171 and 3172 may be described as having identical cylindrical surfaces. The embodiments of FIGS. 27–31 illustrate only a few of the many possible variations. Depending on the dimension and arrangement of parts, for example, the roller may not rotate through an entire cycle during exercise, in which case the interface surfaces need not extend all the way around the roller.

Still more possible variations of the present invention are illustrated in FIGS. 32–33. In FIG. 32, an alternative support member 3210 is shown as a possible substitute for the "underlying" rack and/or support member provided on any of the foregoing embodiments shown in FIGS. 11–26. The support member 3210 may be described as having a rack of gear teeth disposed along an upwardly convex surface.

In FIG. 33, an alternative support member 3310 is shown as a possible substitute for the "overlying" rack and/or force receiving member provided on any of the foregoing embodiments shown in FIGS. 11–26. The support member 3310 may be described as having a rack of gear teeth disposed along an downwardly convex surface.

Although the present invention has been described with reference to particular embodiments and applications, those skilled in the art will recognize additional embodiments, modifications, and/or applications which fall within the scope of the present invention. For example, in addition to the variations discussed above, one skilled in the art might be inclined to further provide any of various known inertia altering devices, including, for example, a motor, a "stepped up" flywheel, or an adjustable brake of some sort. Additionally, any or all of the components could be modified so that an end of a first component nested between opposing prongs on the end of a second component. Recognizing that, for reasons of practicality, the foregoing description and figures set forth only some of the numerous possible modifications and variations, the scope of the present invention is to be limited only to the extent of the claims which follow.

What is claimed is:

1. An exercise apparatus, comprising:

a frame designed to rest upon a floor surface;

a first left pin mounted on a left side of the frame, and a first right pin mounted on a right side of the frame;

a left crank and a right crank, wherein each said crank is rotatably mounted on the frame and rotatable about a common crank axis;

a second left pin and a second right pin, wherein each said second pin is mounted on a respective crank at a radial distance from the crank axis, and the second left pin and the second right pin cooperate to define a crank diameter;

a left rail and a right rail, wherein a first end of the left rail is rollably supported on one said left pin, and an opposite, second end of the left rail is pivotally connected to the other said left pin, and a first end of the right rail is rollably support on one said right pin, and an opposite, second end of the right rail is pivotally connected to the other said right pin;

a left foot support and a right foot support, wherein each said foot support is rollably mounted on a respective rail; and a left cable assembly and a right cable assembly, wherein each said cable assembly links rotation of a respective crank to movement of a respective foot support through a generally elliptical path having a length that is twice the crank diameter.

2. The exercise apparatus of claim 1, wherein a left roller is rotatably mounted on the second left pin, and a right roller is rotatably mounted on the second right pin.

3. The exercise apparatus of claim 1, wherein each said pin is secured to the frame.

4. The exercise apparatus of claim 1, wherein the generally elliptical path has a height that is measured perpendicular to the length, and the height is less than the crank diameter.

5. The exercise apparatus of claim 1, wherein each said foot support moves up and down together with its respective rail, and each said foot support moves back and forth relative to its respective rail.

6. An exercise apparatus, comprising:

a frame designed to rest upon a floor surface, wherein left and right first rail supports are mounted on respective sides of the frame;

a left crank and a right crank, wherein each said crank is rotatably mounted on a respective side of the frame and rotatable about a common crank axis, and left and right second rail supports are mounted on respective cranks and cooperate to define a crank diameter therebetween;

a left rail and a right rail, wherein each said rail is movably interconnected between respective first and second rail supports, and each said rail is pivotally coupled to one of said rail supports, and rollably supported on another of said rail supports;

a left foot support and a right foot support, wherein each said foot support is rollably mounted on a respective rail; and a left cable assembly and a right cable assembly, wherein each said cable assembly links rotation of a respective crank to movement of a respective foot support through a generally elliptical path having a length that is twice the crank diameter.

7. The exercise apparatus of claim 6, wherein each of the second rail supports is a roller that is rotatably mounted on a respective crank member.

8. The exercise apparatus of claim 6, wherein each of the first rail supports is a pin that is secured to the frame.

9. The exercise apparatus of claim 6, wherein the generally elliptical path has a height that is measured perpendicular to the length, and the height is less than the crank diameter.

10. The exercise apparatus of claim 6, wherein each said foot support moves up and down together with its respective rail, and each said foot support moves back and forth relative to its respective rail.

* * * * *